US007344633B2

(12) United States Patent
Collin et al.

(10) Patent No.: US 7,344,633 B2
(45) Date of Patent: Mar. 18, 2008

(54) PROCESS TO PREPARE A BASE OIL HAVING A HIGH SATURATES CONTENT

(75) Inventors: Marc Collin, Petit Couronne (FR); Eric Duprey, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 279 days.

(21) Appl. No.: 10/474,928

(22) PCT Filed: Apr. 19, 2002

(86) PCT No.: PCT/EP02/04417

§ 371 (c)(1),
(2), (4) Date: Oct. 16, 2003

(87) PCT Pub. No.: WO02/086025

PCT Pub. Date: Oct. 31, 2002

(65) Prior Publication Data

US 2004/0065587 A1 Apr. 8, 2004

(51) Int. Cl.
*C10G 47/02* (2006.01)
*C10G 35/04* (2006.01)

(52) U.S. Cl. ..... 208/58; 208/60; 208/138; 208/114; 208/118; 208/111.35; 208/89; 208/97

(58) Field of Classification Search ..... 208/58, 208/60, 138, 114, 118, 111.35, 89, 97
See application file for complete search history.

(56) References Cited

U.S. PATENT DOCUMENTS 3,673,078 A 6/1972 Kirk, Jr.
4,574,043 A 3/1986 Chester et al.

(Continued)

FOREIGN PATENT DOCUMENTS

DE 2935191 4/1981

(Continued)

OTHER PUBLICATIONS

API Publication 1509: Engine Oil Licensing and Certification System, Appendix E-API Base Oil Interchangeability Guidelines for Passenger Car Motor Oil and Diesel Engine Oils.

(Continued)

*Primary Examiner*—Tam M. Nguyen
(74) *Attorney, Agent, or Firm*—Charles W. Stewart

(57) ABSTRACT

A process to prepare a base oil having a saturates content of more than 90 wt %, a sulphur content of less than 0.03 wt %, and, a viscosity index of between 80 and 120 from a solvent refined base oil feedstock, which process comprises:
(a) contacting the solvent refined base oil feedstock in the presence of a hydrogen containing gas in a first reaction zone containing one or more fixed beds of a catalyst, which catalyst comprises at least one Group VIB metal component and at least one non-noble Group VIII metal component supported on a refractory oxide carrier; and
(b) contacting the effluent of step (a) in the presence of a hydrogen containing gas in a second reaction zone containing one or more fixed beds of a catalyst, which catalyst comprises a catalyst comprising a noble metal component supported on an amorphous refractory oxide carrier, wherein the oil feedstock in step (a) flows counter-current to the up flowing hydrogen containing gas.

32 Claims, 1 Drawing Sheet

U.S. PATENT DOCUMENTS

| | | | | | |
|---|---|---|---|---|---|
| 4,859,311 | A | | 8/1989 | Miller | |
| 5,053,373 | A | | 10/1991 | Zones | |
| 5,157,191 | A | | 10/1992 | Bowes | |
| 5,252,527 | A | | 10/1993 | Zones | |
| 5,935,416 | A | | 8/1999 | Cody et al. | |
| 5,976,354 | A | | 11/1999 | Powers et al. | |
| 5,993,644 | A | * | 11/1999 | Xiao et al. | 208/89 |
| 6,007,787 | A | * | 12/1999 | Gupta et al. | 422/191 |
| 6,051,127 | A | * | 4/2000 | Moureaux | 208/58 |

FOREIGN PATENT DOCUMENTS

| | | | |
|---|---|---|---|
| EP | 0181254 | | 1/1988 |
| EP | 0329499 | | 1/1991 |
| EP | 0448435 | | 8/1992 |
| EP | 0564317 | | 3/1995 |
| EP | 0832171 | | 1/2000 |
| GB | 1381004 | | 1/1975 |
| WO | 93/02793 | | 2/1993 |
| WO | 94/10263 | | 5/1994 |
| WO | 94/25157 | | 11/1994 |
| WO | 97/18278 | | 5/1997 |
| WO | 98/02502 | | 1/1998 |
| WO | WO 98/01515 | * | 1/1998 |
| WO | 00/29511 | | 5/2000 |
| WO | 00/73402 | | 12/2000 |

OTHER PUBLICATIONS

"Lubricating Base Oil and Wax Processing", by Avilino Sequeira, Jr., 1994, Marcel Dekker Inc., NY, pp. 81-118 and pp. 153-224.
Worldwide Catalyst Report, Oil & Gas Journal Special, Sep. 27, 1999, pp. 53-58.
International Search Report dated Aug. 7, 2002.

* cited by examiner

PROCESS TO PREPARE A BASE OIL HAVING A HIGH SATURATES CONTENT

FIELD OF THE INVENTION

The invention is directed to a process to prepare a base oil having a saturates content of more than 90 wt %, a sulphur content of less than 0.03 wt % and a viscosity index of between 80 and 120 from a solvent refined base oil feedstock. Such a base oil is sometimes referred to as an API Group II base oils as defined in API Publication 1509: Engine Oil Licensing and Certification System, "Appendix E-API Base Oil Inter-changeability Guidelines for Passenger Car Motor Oil and Diesel Engine Oils".

BACKGROUND OF THE INVENTION

There exists an increasing demand for these products due to the fact that modern automobile engines operate under more severe conditions, requiring a lubricating oil which is formulated based on a base oil having the above specifications. The API Group II base oils are also valuable for Industrial Lubricants, because of their improved inhibited oxidation stability.

A process to prepare API Group II base oils is described in WO-A-0073402 This patent publication describes the preparation of such a base oil from a petroleum fraction boiling in the lubricating oil range by first removing part of the aromatic compounds from a by means of solvent extraction, subsequently dewaxing the solvent extracted product and hydrotreating the dewaxed oil using a suitable sulphided hydrotreating catalyst. The effluent of the hydrotreating step is subsequently separated into a gaseous fraction and a liquid fraction; wherein the liquid fraction has a sulphur content of between 50 and 1000 ppmw and a nitrogen content of less than 50 ppmw. This liquid fraction is subjected to a second hydrotreating step using a catalyst comprising a noble metal component supported on an amorphous refractory oxide carrier.

The above process is not preferred because it involves many process steps to obtain the desired base oil.

U.S. Pat. No. 3,673,078 discloses a counter-current contacting of a solvent refined base oil using a platinum on alumina catalyst. The temperature in the bottom catalyst bed was 343° C. and the difference between the temperature in the top and the bottom catalyst bed was about 14° C.

Although the disclosed processes may be used to prepare low sulphur and low polar compounds containing base oils there is still room for improvement.

SUMMARY OF THE INVENTION

The present invention therefore aims at providing a simple process, which can also reduce the sulphur and polar compounds level in an improved manner.

This is achieved by the following process. Process to prepare a base oil having a saturates content of more than 90 wt %, a sulphur content of less than 0.03 wt % and a viscosity index of between 80 and 120 from a solvent refined base oil feedstock, which process comprises:

(a) contacting the solvent refined base oil feedstock in the presence of a hydrogen containing gas in a first reaction zone containing one or more fixed beds of a catalyst, which catalyst comprises at least one Group VIB metal component and at least one non-noble Group VIII metal component supported on a refractory oxide carrier;

(b) contacting the effluent of step (a) in the presence of a hydrogen containing gas in a second reaction zone containing one or more fixed beds of a catalyst, which catalyst comprises a catalyst comprising a noble metal component supported on an amorphous refractory oxide carrier, wherein the oil feedstock in step (a) flows counter-current to the upflowing hydrogen containing gas.

DETAILED DESCRIPTION OF THE INVENTION

Figure 1:
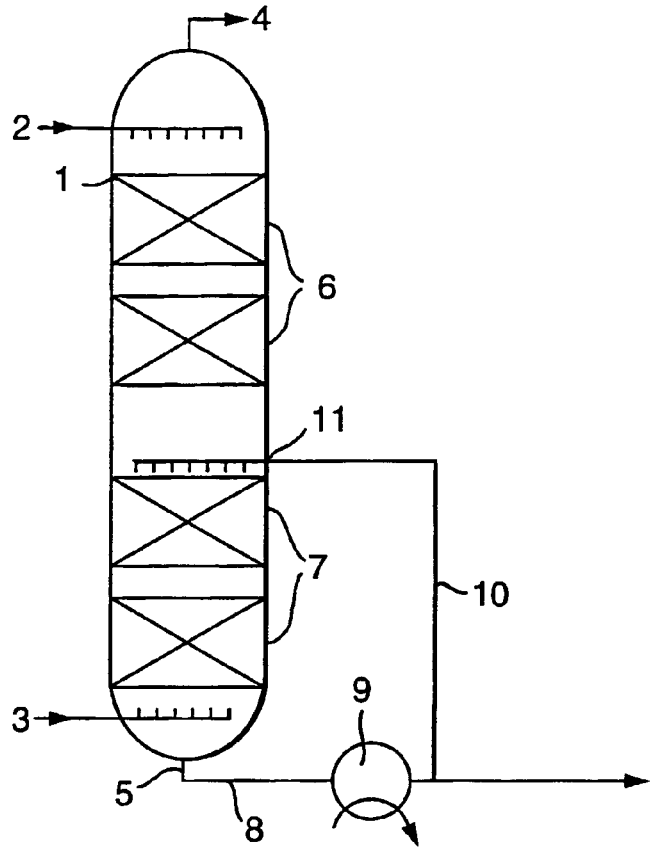
FIG. 1 is a schematic drawing of one embodiment of the invention showing one vessel.

It has been found that with the process according to the invention a more simple process is obtained, wherein a separate gas/liquid separation of the prior art process is not needed. In contrast the present process makes it possible to perform both hydrotreating steps in one vessel. This makes the process even more simple. A further advantage is that the present process can be used in combination with existing solvent refined base oil processes. Such processes can be modified by adding the hydroprocessing steps (a) and (b) to the existing line-up. Most preferably existing hydrofinishing reactors which are usually part of an existing solvent refining base oil process can be retrofitted to a reactor vessel comprising the first and second reaction zones of the process according the invention. Alternatively solvent refined base oils prepared at a different location can be upgraded to API Group II base oils with the process according to the present invention. Furthermore an API Group II base oil product having an excellent colour can be obtained in a high yield based on the solvent refined base oil feedstock using a process which operates at a relatively low pressure.

The solvent refined base oil feedstock will typically have a saturates content of below 90 wt % and is obtained by solvent extraction and solvent dewaxing of a petroleum fraction boiling in the lubricating oil range. Suitable distillate petroleum fractions are vacuum distillate fractions derived from an atmospheric residue, i.e. distillate fractions obtained by vacuum distillation of a residual fraction which in return is obtained by atmospheric distillation of a crude oil. The boiling range of such a vacuum distillate fraction is usually between 300 and 620° C., suitably between 350 and 580° C. However, deasphalted residual oil fractions, including both deasphalted atmospheric residues and deasphalted vacuum residues, may also be applied.

Solvent extraction is a widely applied technology when preparing base oils and is for example described in "Lubricating base oil and wax processing", by Avilino Sequeira, Jr., 1994, Marcel Dekker Inc. New York, pages 81-118. Solvent extraction is suitably performed with for example N-methyl-2-pyrrolidone, furfural, phenol and sulphur dioxide as extraction solvent. Often used solvents are N-methyl-2-pyrrolidone and furfural. In the solvent extraction aromatic compounds are partly removed from the hydrocarbon mixture, thereby increasing the viscosity index of the product. Amounts of sulphur and nitrogen are also removed in the solvent extraction process.

Solvent dewaxing is also a widely applied technology when preparing base oils. Possible solvent dewaxing methods are described in the earlier mentioned textbook "Lubricating base oil and wax processing", by Avilino Sequeira, Jr., 1994, Marcel Dekker Inc. New York, pages 153-224. Solvent dewaxing is performed by chilling the feedstock with a solvent whereby the wax molecules crystallise. The wax crystals are subsequently removed by filtration and the solvent is recovered. Examples of possible solvents are methylethylketone/toluene, methylisobutylketone, methylisobutylketone/methylethyl-ketone, dichloroethylene/methylenechloride, and propane.

The solvent refined base oil feedstock which is fed to step (a) will typically contain less than 90 wt % saturates and have a sulphur content of between 300 ppmw and 2 wt %. The process according to the invention has been found to perform particularly good compared to prior art processes when the feedstock contains relatively high amounts of sulphur, like more than 1000 ppmw. The nitrogen content is preferably less than 50 ppmw. The saturates content is preferably higher than 70 wt %. Next to saturates the base oil mainly consists of aromatic and polar compounds. Examples of polar compounds are specific sulphur and nitrogen containing compounds. The pour point is usually less than 0° C. Particularly suitable solvent refined base oil feedstocks to be used in the present invention are those which are classified as API Group I Base Oils as described in the afore-mentioned API Publication 1509: Engine Oil Licensing and Certification System, "Appendix E-API Base Oil Interchangeability Guidelines for Passenger Car Motor Oil and Diesel Engine Oils".

In the first hydrotreating step (a) the level of sulphur and nitrogen in the liquid flowing downwards through the catalyst bed is reduced. Hydrogen sulphide and ammonia are formed in this step from the organic S- and N-containing compounds. By performing this step counter-current to the upflowing hydrogen gas ammonia and hydrogen sulphide are removed from the downflowing liquid oil and discharged from the first reaction zone with the upflowing gas stream. It has been found that this separation is sufficient to reduce the sulphur and nitrogen levels in the oil leaving the first reaction zone (a) to values which are acceptable for performing step (b). Suitably hydrogen sulphide and ammonia are removed from the gaseous stream leaving step (a) resulting in a cleaned hydrogen containing gas, which is preferably recycled to step (b). Examples of suitably methods for removing hydrogen sulphide and ammonia are methods known in the art, such as an absorption treatment with a suitable absorption solvent, such as solvents based on one or more alkanolamines, for example mono-ethanolamine, di-ethanol-amine, methyl-di-ethanolamine and di-isopropanolamine.

The catalyst to be used in step (a) may be any suitable hydrodenitrification (HDN) and hydrodesulphurization (HDS) catalyst known to one skilled in the art as for example described in Worldwide Catalyst Report, Oil & Gas Journal Special, Sep. 27, 1999, pages 53-58. Other examples are described in U.S. Pat. No. 5,855,767 hereby incorporated by reference. Suitable catalysts comprise at least one Group VIB metal component and at least one non-noble Group VIII metal component selected from the group of iron, nickel or cobalt supported on a refractory oxide carrier. Examples of suitable Group IVB metals are molybdenum (Mo) and tungsten (W). Examples of suitable non-noble Group VIII metals are nickel (Ni) and cobalt (Co). Suitable catalysts include those catalysts comprising as the non-noble Group VIII metal component one or more of nickel (Ni) and cobalt (Co) in an amount of from 1 to 25 percent by weight (wt %), preferably 2 to 15 wt %, calculated as element relative to total weight of catalyst and as the Group VIB metal component one or more of in an amount of from 5 to 30 wt %, preferably 10 to 25 wt %, calculated as element relative to total weight of catalyst. These metal components may be present in elemental, oxidic and/or sulphidic form and are supported on a refractory oxide carrier. The catalyst may also comprise a noble metal from Group VIII next to the above-mentioned metals. Examples of suitable noble metals are palladium and platinum.

The refractory oxide support of the catalyst used in the first hydrotreating step may be any inorganic oxide, alumino-silicate or combination of these, optionally in combination with an inert binder material. Examples of suitable refractory oxides include inorganic oxides, such as alumina, silica, titania, zirconia, boria, silica-alumina and mixtures of two or more of these.

Phosphorus (P), which is a well known promoter, may also be present in the catalyst used in the first hydrotreating step. The phosphorous content is preferably between 1 and 10 wt % as oxide.

Preferred catalyst, more preferably containing a phosphorus promoter, are cobalt/molybdenum on alumina having a cobalt content of between 1-5 wt % as oxide and 10-25 wt % molybdenum content as oxide; nickel/molybdenum on alumina having a nickel content 1-5 wt % as oxide and a molybdenum content of between 10-30 wt % as oxide of which commercially available catalyst DN-190 of Criterion Catalyst Company (Houston, Tex.) is an example; and nickel/tungsten on alumina having a nickel content of between 1-5 wt % as oxide and a tungsten content of between 10-30 wt % as oxide.

Since the base oil feed to be converted in step (a) will contain sulphur-containing compounds, the catalyst used in the first hydrotreating step is at least partly sulphided prior to operation in order to increase its sulphur tolerance. Presulphiding of the catalyst can be achieved by in-situ or ex-situ methods known in the art, such as for instance those methods disclosed in the following publications EP-A-181254, EP-A-329499, EP-A-448435, EP-A-564317, WO-A-9302793 and WO-A-9425157 all of which are hereby incorporated by reference.

In general, presulphiding is effected by contacting the unsulphided catalyst with a suitable sulphiding agent, such as hydrogen sulphide, elemental sulphur, a suitable polysulphide, a hydrocarbon oil containing a substantial amount of sulphur-containing compounds or a mixture of two or more of these sulphiding agents. Particularly for the in situ sulphidation a hydrocarbon oil containing a substantial amount of sulphur-containing compounds may suitably be used as the sulphiding agent. Such oil is then contacted with the catalyst at a temperature which is gradually increased from ambient temperature to a temperature of between 150 and 250° C. The catalyst is to be maintained at this temperature for between 10 and 20 hours. Subsequently, the temperature is to be raised gradually to the operating temperature. A particular useful hydrocarbon oil presulphiding agent may be the base oil feed itself, which contains a significant amount of sulphur-containing compounds. In this case the unsulphided catalyst may be contacted with the feed under, for example, the operating conditions, thus causing the catalyst to become sulphided. Typically, the base oil feed should comprise at least 0.5% by weight of sulphur-containing compounds, said weight percentage indicating the amount of elemental sulphur relative to the total amount of feedstock, in order to be useful as a sulphiding agent.

Step (a) is suitably operated as follows. The temperature is between 250 and 400° C. and preferably between 300 and 370° C. The actual temperature and other operating conditions will depend largely on the content of sulphur and/or nitrogen in the feed and the desired reduction to be achieved as described above. Higher temperatures, for example, result in higher reduction of S- and N-content. The total pressure may range from 10 to 250 bar, but preferably is between 40 and 100 bar. The weight hourly space velocity (WHSV) may range from 0.1 to 10 kg of oil per litre of catalyst per hour (kg/l.h) and suitably is in the range from 0.2 to 5 kg/l.h.

In step (b) the liquid fraction obtained in step (a) is contacted in the presence of hydrogen and a catalyst comprising a Group VIII noble metal component supported on an amorphous refractory oxide carrier. In step (b) part of the aromatic compounds are hydrogenated to saturated compounds. The catalyst preferably comprises at least one noble Group VIII metal component supported on an amorphous refractory oxide carrier. Suitable noble Group VIII metal components are platinum and palladium. The catalyst suitably comprises platinum, palladium or both. The total amount of noble Group VIII metal component(s) present suitably ranges from 0.1 to 10 wt %, preferably 0.2 to 5 wt %, which weight percentage indicates the amount of metal (calculated as element) relative to total weight of catalyst.

It has been found particular important that the catalyst comprises an amorphous refractory oxide as the carrier material. Examples of suitable amorphous refractory oxides include inorganic oxides, such as alumina, silica, titania, zirconia, boria, silica-alumina, fluorided alumina, fluorided silica-alumina and mixtures of two or more of these. Of these, amorphous silica-alumina is preferred, whereby silica-alumina comprising from 5 to 75 wt % of alumina has been found to be particularly preferred. Examples of suitable silica-alumina carriers are disclosed in WO-A-9410263 hereby incorporated by reference. Examples of suitable catalysts are catalyst comprising platinum or palladium on an amorphous silica-alumina carrier. More preferably the catalyst comprises platinum and palladium supported on an amorphous silica-alumina carrier. A most preferred catalyst comprises an alloy of palladium and platinum preferably supported on an amorphous silica-alumina carrier of which the commercially available catalyst C-624, C-634, C-652 and C-654 of Criterion Catalyst Company (Houston, Tex.) are examples. These platinum/palladium catalyst are advantageous because they deactivate less when the sulphur content of the liquid effluent of step (a) is relatively high as can be the case in the present invention. The hydrogen containing gas flows counter-current to the oil feedstock in step (a). In step (b) the hydrogen containing gas may flow co-current or counter-current. The co-current option may be chosen when steps (a) and (b) are performed in different vessels, while the counter-current option may be chosen when steps (a) and (b) are performed in one vessel.

Suitably the temperature in step (b) is equal or lower than the temperature in step (a). More-preferably the temperature in step (b) is more than 30° C., even more preferably more than 35° C. and most preferably more than 40° C. lower than in step (a). In a situation wherein the hydrogen containing gas flows counter-current in both steps (a) and (b) the temperature in steps (a) and (b) can be controlled by adjusting the temperature of the solvent refined feedstock and/or the hydrogen fed to step (b). Optionally additional hydrogen having a higher temperature can be fed directly to step (a) in order to achieve a higher reaction temperature in this step. Optionally the temperature in steps (a) and (b) can be controlled by indirect heat exchange in the catalyst beds themselves, for example by means of heat exchange tubes present in these beds. The temperature of the feed to step (b) can also be reduced by cooling the effluent of step (a) in an external heat exchanger before feeding it to step (b). With external heat exchanger is meant any indirect heat exchanger placed outside the vessel containing the catalyst beds. This option can be used when steps (a) and (b) are performed in one vessel or in separate vessels. In case steps (a) and (b) are performed in one vessel the effluent of step (a) can be withdrawn by means of a so-called withdraw tray. Suitably cooling of the effluent of step (a) before being used in step (b) can be achieved by recycling part of the, suitably cooled, effluent of step (b) to step (b).

The total pressure in steps (a) and (b) are suitably the same when the fixed catalyst beds of the first reaction zone (a) are placed in the same vessel as the catalyst beds of the second reaction zone (b). This will be referred to as the stacked-bed embodiment. The temperature in step (b) will suitably not exceed 350° C. and preferably is in the range of from 150 and 350° C., more preferably from 250 to 320° C. The operating total pressure may range from 10 to 250 bar and preferably is in the range of from 40 to 100 bar. The WHSV may range from 0.1 to 10 kg of oil per litre of catalyst per hour (kg/l.h) and suitably is in the range from 0.5 to 6 kg/l.h.

In the stacked-bed embodiment the fixed catalyst bed(s) of the first reaction zone (a) are placed above the catalyst bed(s) of the second reaction zone (b).

Optionally an additional catalytic dewaxing or isodewaxing step can be performed on the solvent refined base oil feedstock. This may be advantageous when low pour points are desired. Preferably such a pour point reducing step is performed after step (a) and before step (b). It may be performed in a counter-current mode as in step (a). Optionally when this pour point reducing treatment is performed in a separate vessel than step (a) co-current contacting of the effluent of step (a) and hydrogen in the presence of a suitable catalyst is also possible. The catalytic dewaxing can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of a base oil precursor fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311 hereby incorporated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043 all of which are hereby incorporated by reference.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-0029511 hereby incorporated by reference. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171 hereby incorporated by reference.

Figure 2:
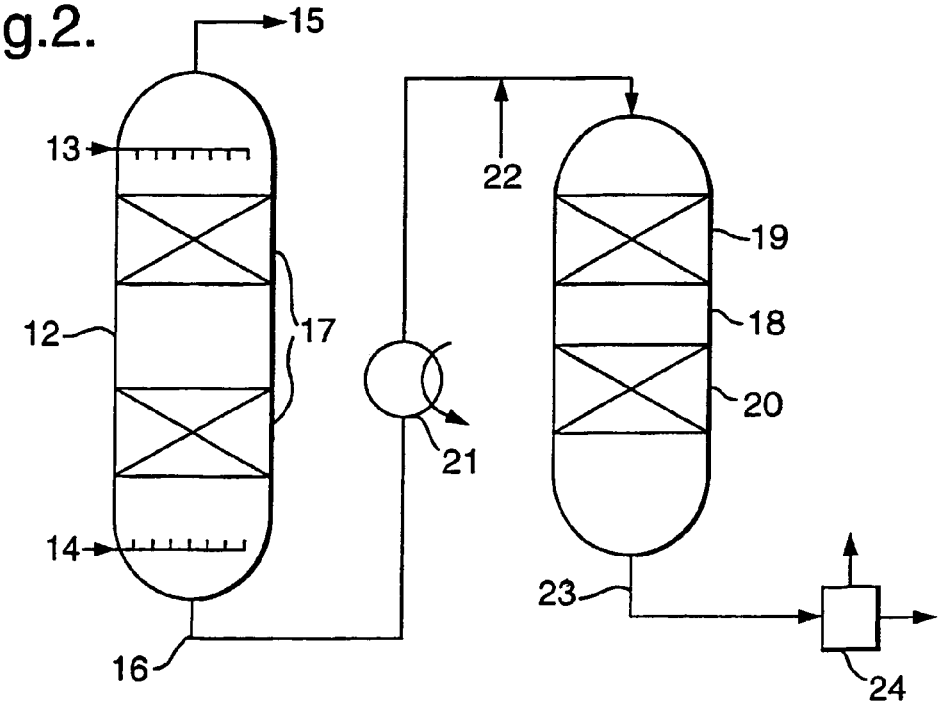
FIG. 2 is a schematic drawing of one embodiment of the invention showing two vessels.

Possible preferred embodiments of the present invention are illustrated in FIGS. 1-2. FIG. 1 shows one vessel (1) provided with an inlet (2) for receiving solvent refined base oil feedstock, an inlet (3) for fresh hydrogen, an outlet (4) for used hydrogen and an outlet (5) for the desired base oil product. The vessel (1) is furthermore provided with two catalyst beds (6) for performing step (a) and two catalyst beds (7) to perform step (b). The product effluent being discharged via line (8) is cooled in heat exchanger (9). Part of this cooled product may be recycled via (10) to a position (11) between the catalyst beds of step (a) and (b) to cool down the effluent of step (a) before it contacts the catalyst beds of step (b). The hydrogen being discharged via outlet (4) will be freed from hydrogen sulphide and ammonia in a cleaning unit (not shown) before being recycled to step (b).

FIG. 2 shows a two vessel configuration consisting of a first vessel (12) provided with a inlet (13) for receiving solvent refined base oil feedstock, an inlet (14) for receiving hydrogen, an outlet (15) for non-consumed hydrogen and an outlet (16). The vessel (12) is provided with two catalyst beds (17) for performing step (a) in a counter-current operation. FIG. 2 also shows a second vessel (18) for performing step (b) in a co-current mode of operation. As a top catalyst bed (19) in vessel (18) a dewaxing or isodewaxing catalyst may optionally be present. Vessel (18) is further provided with a one or more catalyst beds (20) for performing step (b). The effluent of vessel (12) may be reduced in temperature in heat exchanger (21). The feed to vessel (18) is mixed with fresh hydrogen (22). The vessel (18) is further provided with a outlet (23) for the desired base oil product. From this product non-consumed hydrogen is separated in gas-liquid separator (24). This hydrogen may suitably be directly used as feed to vessel (12) via inlet (14). The hydrogen being discharged via outlet (15) will be freed from hydrogen sulphide and ammonia in a cleaning unit (not shown) before it is re-used via hydrogen supply means (22).

The invention will be illustrated by the following non-limiting examples.

EXAMPLE 1

A solvent refined base oil obtained by performing an extraction with furfural on a vacuum distillate followed by a solvent dewaxing step using methylethylketone/toluene having the properties as listed in Table 1 was continuously fed to the top of a stacked bed reactor. The top catalyst bed consisted of a commercial NiMo on alumina catalyst (DN-190 of Criterion Catalyst Company (Houston, Tex.). The bottom bed contained bed consisted of a commercial PtPd on amorphous silica-alumina carrier (C-624 of Criterion Catalyst Company (Houston, Tex.). To the bottom of the stacked bed reactor hydrogen was continuously fed. The operating conditions were a hydrogen partial pressure of 80 bar, a WHSV of 1 kg/l/h in the top catalyst bed and a WHSV of 0.87 kg/l/h in the bottom catalyst. The fresh hydrogen inlet flow was 65 Nl/h. The temperature in the top bed was 350° C. and the temperature in the second bed was 320° C. The properties of the base oil product leaving the stacked-bed reactor is presented in Table 1.

EXAMPLE 2

Example 1 was repeated, except in that the temperature in the bottom bed was 290° C. The properties of the final base oil product are in Table 1.

EXAMPLE 3

Example 1 was repeated, except in that the temperature in the bottom bed was 310° C. and the temperature in the top bed was 340° C. The properties of the final base oil product are in Table 1.

TABLE 1

| Example | base oil feed-stock feed | API Group II BASE OIL 1 | API Group II BASE OIL 2 | API Group II BASE OIL 3 |
|---|---|---|---|---|
| temperature 1st reaction zone (° C.) | — | 350 | 350 | 340 |
| temperature 2nd reaction zone (° C.) | — | 320 | 290 | 310 |
| saturates (wt %) | 72.8 | 98.2 | 98.7 | 98.1 |
| polars (wt %) | 27.2 | 1.8 | 1.3 | 1.9 |
| sulphur (mg/kg) | 7700 | 2 | 5 | 8 |
| nitrogen (mg/kg) | .23 | <1 | <1 | <1 |
| Viscosity Index | 104 | 109 | 107 | 107 |
| viscosity at 100° C. (cSt) | 5.2 | 4.1 | 4.6 | 4.4 |
| viscosity at 40° C. (cSt) | 29.5 | 20.0 | 23.9 | 22.5 |
| pour point (° C.) | −16 | −11 | −11 | −11 |
| colour Saybolt | | +26 | +28 | +27 |

We claim:

1. A process to prepare a base oil having a saturates content of more than 90 wt %, a sulphur content of less than 0.03 wt %, and, a viscosity index of between 80 and 120 from a solvent refined base oil feedstock that is obtained by solvent extraction and solvent dewaxing of a distillate petroleum fraction having a boiling range between 300 and 620° C. and obtained by vacuum distillation of a residual fraction obtained by atmospheric distillation of a crude oil, wherein the solvent refined base oil feedstock comprises between 300 ppm and 2 wt % sulfur and between 70 and 90 wt % saturates, said process comprises:

(a) contacting the solvent refined base oil feedstock in the presence of an upflowing hydrogen containing gas in a first reaction zone containing one or more fixed beds of a first catalyst, which the first catalyst comprises at least one Group VIB metal component and at least one non-noble Group VIII metal component supported on a refractory oxide carrier, wherein the flow of the solvent refined base oil feedstock within the first reaction zone is counter-current to the upflowing hydrogen containing gas and yielding from the first reaction zone a liquid fraction effluent and a gaseous stream; and (b) contacting the liquid fraction effluent of step (a), without first performing a separate gas/liquid separation of the liquid fraction effluent, in the presence of a hydrogen containing gas in a second reaction zone containing one or more fixed beds of a second catalyst, which the second catalyst comprises a noble metal component supported on an amorphous refractory oxide carrier and yielding from the second reaction zone the base oil.

2. The process according to claim 1, wherein the first catalyst used in step (a) comprises cobalt, molybdenum and an alumina support.

3. The process according to claim 2, wherein the second catalyst used in step (b) comprises an alloy of platinum and palladium and a silica-alumina support.

4. The process according to claim 3, wherein the temperature in step (a) is between 300° C. and 370° C. and the temperature in step (b) is between 250° C. and 320° C.

5. The process according to claim 4, wherein the temperature in step (b) is more than 35° C. lower than in step (a).

6. The process according to claim 5, wherein the total pressure in steps (a) and (b) are between 40 and 100 bar.

7. The process according to claim 6, wherein step (b) is performed such that the liquid fraction effluent of step (a) flows within the second reaction zone counter-current to the hydrogen containing gas, and wherein the hydrogen containing gas is flowing upwardly within the second reaction zone.

8. The process according to claim 7, wherein steps (a) and (b) are performed in one vessel.

9. The process according to claim 8, wherein the liquid fraction effluent of step (a) is reduced in temperature by mixing it with part of the the base oil of step (b), which has been reduced in temperature relative to the temperature of step (b).

10. The process according to claim 7, wherein prior to step (b) a catalytic (iso)dewaxing step is performed on the liquid fraction effluent of step (a).

11. The process according to claim 10, the (iso)dewaxing step is performed in a separate vessel from the vessel in which step (a) is performed.

12. The process according to claim 1, wherein the first catalyst used in step (a) comprises cobalt, molybdenum and an alumina support; or nickel, molybdenum and an alumina support; or nickel, tungsten and an alumina support.

13. The process according to claim 1, wherein the second catalyst used in step (b) comprises an alloy of platinum and palladium and a silica-alumina support.

14. The process according to claim 1, wherein the temperature in step (a) is between 300° C. and 370° C. and the temperature in step (b) is between 250° C. and 320° C.

15. The process according to claim 2, wherein the temperature in step (a) is between 300° C. and 370° C. and the temperature in step (b) is between 250° C. and 320° C.

16. The process according to claim 1, wherein the total pressure in steps (a) and (b) are between 40 and 100 bar.

17. The process according to claim 2, wherein the total pressure in steps (a) and (b) are between 40 and 100 bar.

18. The process according to claim 3, wherein the total pressure in steps (a) and (b) are between 40 and 100 bar.

19. The process according to claim 4, wherein the total pressure in steps (a) and (b) are between 40 and 100 bar.

20. The process according to-claim 1, wherein step (b) is performed such that the liquid fraction effluent of step (a) flows within the second reaction zone counter-current to the hydrogen containing gas, and wherein the hydrogen containing gas is flowing upwardly within the second reaction zone.

21. The process according to claim 2, wherein step (b) is performed such that the liquid fraction effluent of step (a) flows within the second reaction zone counter-current to the up flowing hydrogen containing gas, and wherein the hydrogen containing gas is flowing upwardly within the second reaction zone.

22. The process according to claim 3, wherein step (b) is performed such that the liquid fraction effluent of step (a) flows within the second reaction zone counter-current to the up flowing hydrogen containing gas, and wherein the hydrogen containing gas is flowing upwardly within the second reaction zone.

23. The process according to claim 4, wherein step (b) is performed such that the liquid fraction effluent of step (a) flows within the second reaction zone counter-current to the up flowing hydrogen containing gas, and wherein the hydrogen containing gas is flowing upwardly within the second reaction zone.

24. The process according to claim 5, wherein step (b) is performed such that the liquid fraction effluent of step (a) flows within the second reaction zone counter-current to the up flowing hydrogen containing gas, and wherein the hydrogen containing gas is flowing upwardly within the second reaction zone.

25. The process according to claim 1, wherein prior to step (b) a catalytic (iso)dewaxing step is performed on the liquid fraction effluent of step (a).

26. The process according to claim 2, wherein prior to step (b) a catalytic (iso)dewaxing step is performed on the liquid fraction effluent of step (a).

27. The process according to claim 3, wherein prior to step (b) a catalytic (iso)dewaxing step is performed on the liquid fraction effluent of step (a).

28. The process according to claim 4, wherein prior to step (b) a catalytic (iso)dewaxing step is performed on the liquid fraction effluent of step (a).

29. The process according to claim 5, wherein prior to step (b) a catalytic (iso)dewaxing step is performed on the liquid fraction effluent of step (a).

30. The process according to claim 6, wherein prior to step (b) a catalytic (iso)dewaxing step is performed on the liquid fraction effluent of step (a).

31. The process according to claim 7, wherein prior to step (b) a catalytic (iso)dewaxing step is performed on the liquid fraction effluent of step (a).

32. The process according to claim 8, wherein prior to step (b) a catalytic (iso)dewaxing step is performed on the liquid fraction effluent of step (a).

* * * * *